United States Patent [19]

Clement

[11] Patent Number: 4,988,214

[45] Date of Patent: Jan. 29, 1991

[54] SEQUENTIAL DRAWER SLIDE

[75] Inventor: Gene R. Clement, Grandville, Mich.

[73] Assignee: Knape & Vogt Manufacturing Co., Grand Rapids, Mich.

[21] Appl. No.: 897,779

[22] Filed: Aug. 18, 1986

[51] Int. Cl.[5] ..... A47B 88/04; F16C 29/04

[52] U.S. Cl. ..... 384/18; 312/333; 312/334; 312/341.1

[58] Field of Search ..... 384/18–21; 312/330 R, 333, 334, 338, 339, 341 R, 342, 348

[56] References Cited

U.S. PATENT DOCUMENTS

| | | |
|---|---|---|
| 1,537,067 | 5/1925 | Card . |
| 2,125,619 | 8/1938 | Parent . |
| 2,430,141 | 11/1947 | Reeves . |
| 2,606,090 | 8/1952 | Straubel . |
| 2,687,924 | 8/1954 | Gomersall . |
| 2,728,626 | 12/1955 | Gussack . |
| 2,739,027 | 3/1956 | Gussack . |
| 2,805,106 | 9/1957 | Penkala . |
| 2,859,070 | 11/1958 | Gomersall . |
| 2,869,961 | 1/1959 | Gomersall . |
| 3,050,348 | 8/1962 | Pipe . |
| 3,078,129 | 2/1963 | Beeck . |
| 3,131,982 | 5/1964 | Bullock . |
| 3,203,749 | 8/1965 | Bullock et al. . |
| 3,297,386 | 1/1967 | Stanek et al. . |
| 3,371,968 | 3/1968 | Loake . |
| 3,431,042 | 3/1969 | Pipe . |
| 3,449,033 | 6/1969 | Pipe . |
| 3,488,097 | 1/1970 | Fall . |
| 3,521,939 | 7/1970 | Fall et al. . |
| 3,545,833 | 12/1970 | Stein et al. . |
| 3,588,198 | 6/1971 | Stewart et al. . |
| 3,687,505 | 8/1972 | Fall et al. . |
| 3,722,964 | 3/1973 | Chitester et al. . |
| 3,778,120 | 12/1973 | Hagen et al. . |
| 3,857,618 | 12/1974 | Hagen et al. . |
| 3,901,564 | 8/1975 | Armstrong . |
| 3,901,565 | 8/1975 | Hagen et al. . |
| 3,904,254 | 9/1975 | Hagen et al. . |
| 3,911,835 | 10/1975 | Schill . |
| 3,912,341 | 10/1975 | Stein . |
| 3,975,063 | 8/1976 | Mahotka et al. . |
| 4,025,138 | 5/1977 | Kittle . |
| 4,067,632 | 1/1978 | Sekerich . |
| 4,183,596 | 1/1980 | Greene et al. . |
| 4,272,139 | 6/1981 | Fler . |
| 4,370,007 | 1/1983 | Fler . |
| 4,469,384 | 9/1984 | Fler et al. . |
| 4,537,450 | 8/1985 | Baxter . |
| 4,549,773 | 10/1985 | Papp et al. . |
| 4,560,212 | 12/1985 | Papp et al. . |

FOREIGN PATENT DOCUMENTS

| | | |
|---|---|---|
| 1814714 | 7/1970 | Fed. Rep. of Germany . |
| 2721231 | 11/1978 | Fed. Rep. of Germany . |
| 342716 | 1/1960 | Switzerland . |
| 2028109 | 3/1980 | United Kingdom . |

*Primary Examiner*—Thomas R. Hannon

*Attorney, Agent, or Firm*—Price, Heneveld, Cooper, DeWitt & Litton

[57] ABSTRACT

The specification discloses a sequential drawer slide having a simple yet positively reliable sequencing mechanism. The mechanism includes a gravity operable control lever carried by the intermediate slide member and shiftable at the transition point between two positions, each wherein either the cabinet or drawer slide member is interlocked with the intermediate member. The single control lever therefore provides full sequencing of the slide members.

28 Claims, 4 Drawing Sheets

FIG. 3
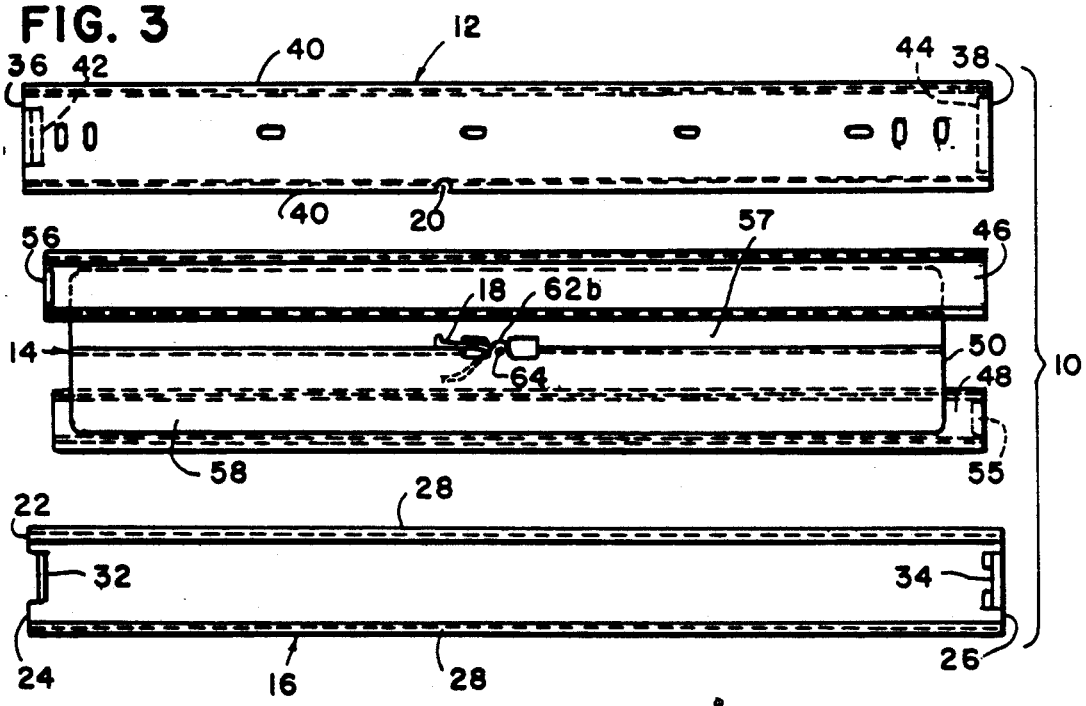
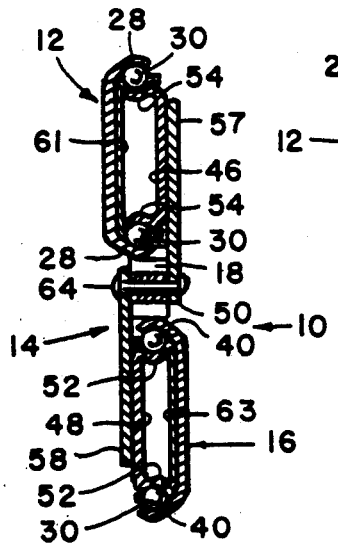
FIG. 4
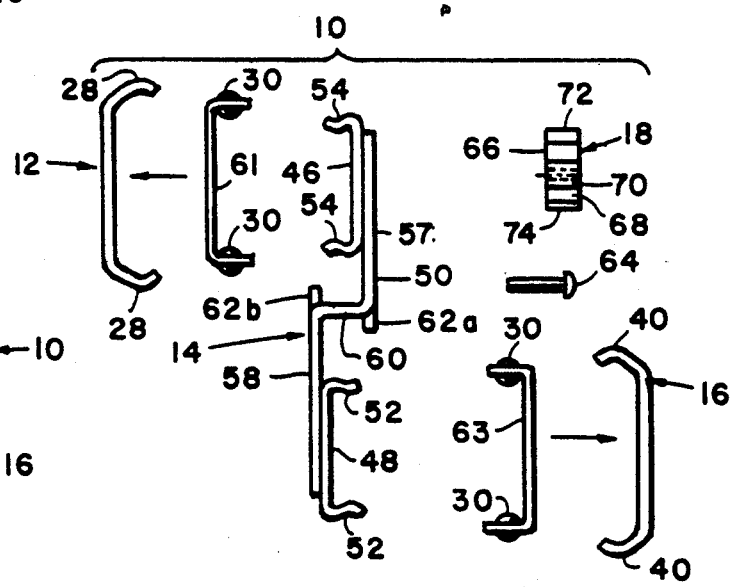
FIG. 5

SEQUENTIAL DRAWER SLIDE

BACKGROUND OF THE INVENTION

The present invention relates to a multi-part drawer slide, and more particularly to a sequential drawer slide wherein movement of the slide parts is sequenced during opening and closing of the drawer.

A wide variety of multi-part drawer slides has been developed to support a drawer within a cabinet. Multi-part slides permit the supported drawer to be fully withdrawn from the cabinet and are therefore often used for office filing cabinet drawers and other applications where full access to the drawer is important.

Typically, multi-part slides include a drawer slide member to be secured to a drawer, a cabinet slide member to be secured to a cabinet, and an intermediate slide member slidingly interfitted with both of the drawer and cabinet slide members. Proper coordination of the movement of the slide members is important to prevent binding and/or racking of the slide, which creates highly detrimental dynamic stress loading in the slide members. Random or uncoordinated movement of the various slide members results in (1) lateral swaying of the drawer, (2) undesirably high opening and closing forces, and (3) increased wear and decreased service life because of the dynamic stress loading.

In efforts to overcome the problems associated with random slide movement, coordinating mechanisms for multi-part slides have been developed. Such mechanisms fall into one of two broad categories—progressive slides and sequential slides. Both types of mechanisms are typically incorporated into "precision drawer slides" which have exact tolerances between the various slide components.

In progressive slides, the intermediate slide moves at exactly one-half the rate or distance of the drawer slide during all opening and closing movement. Stated another way, the intermediate slide always moves an equal distance relative both the drawer and cabinet slides. These slides most typically include rollers, cables or racks-and-pinions as the sequencing mechanism. Rollers are most frequently used; and illustrative constructions are shown in U.S. Pat. Nos. 4,067,632, issued Jan. 10, 1978 to Sekerich, entitled DRAWER SLIDE; 3,901,565, issued Aug. 26, 1975, to Hagen et al, entitled ADAPTOR AND LATCHING MEANS FOR REMOVABLY ATTACHING DRAWERS TO TELESCOPING BALL BEARING DRAWER SLIDES; and 3,901,564, issued Aug. 26, 1975, to Armstrong entitled DRAWER EXTENSIBLE SLIDE CHASSIS. However, all progressive slides have a relatively short useful life because of the relatively high and constant dynamic stresses borne primarily by the cabinet slide member as the intermediate slide member always moves relative thereto. Further, all progressive coordinating mechanisms create a constant resistive opening and closing force or drag. Those mechanisms utilizing a roller also wear rapidly with subsequent failure. All of these problems are exacerbated when the drawers are wide and/or heavily loaded—for example in one of the most common uses in lateral file cabinets.

Sequential drawer slides were developed in part to enhance the life of the drawer slide by reducing the dynamic stress loading on all of the slide members, particularly the cabinet member. In sequential slides, only two slide members are permitted to move relative one another at any given time. Movement of the drawer slide member with respect to the intermediate slide member occurs only when the intermediate slide member is locked with respect to the cabinet slide member and vice versa. Most desirably, the sequencing mechanism (1) interlocks the drawer and intermediate slide members during their extension as the drawer is initially withdrawn from the cabinet, and then (2) releases the drawer and intermediate members and interlocks the fully extended intermediate slide member and the cabinet slide member as the drawer slide member is extended as opening is continued. The sequencing mechanism insures full extension of the intermediate slide member before any extension of the drawer slide member to reduce the dynamic stress loading on the cabinet slide member and enhance the life of the slide. However, known sequencing mechanisms often "catch" and require a large opening or closing force at the transition point between movement of the intermediate slide member and the drawer slide member. Further, known sequencing mechanisms are relatively complex, resulting in high manufacturing cost and less than desirable reliability.

SUMMARY OF THE INVENTION

The aforementioned problems are overcome in the present invention wherein a sequential drawer slide includes a single shiftable control lever to simply yet positively sequence all movement of the slide members. More particularly, the shiftable control lever is carried by the intermediate slide member and is engagable with receivers on the drawer and cabinet slide members. In a first position, the control lever engages the drawer receiver to interlock the drawer and intermediate slide members for relative movement with respect to the cabinet slide member. In a second position, the control lever engages the cabinet receiver to interlock the intermediate and cabinet slide members during relative movement of the drawer slide member. The control lever smoothly and gently shifts between its first and second positions at the transition point of the slide so that little or no "catch" or drag (i.e. increase in the opening or closing force) is noted at the transition point.

The defined construction provides extremely reliable sequencing movement for the slide. Tests conducted to date indicate that the present slide has a useful life of 4 to 8 times more cycles than progressive slides currently commercially available. The cost of manufacture is low, and the ease of manufacture is high.

These and other objects, advantages, and features of the invention will be more readily understood and appreciated by reference to the detailed description of the preferred embodiment and the drawings.

BRIEF DESCRIPTION OF THE DRAWINGS

FIG. 3 is a plan exploded view of the slide;

FIG. 4 is a sectional view taken along plane IV—IV in FIG. 1;

FIG. 5 is an exploded view of FIG. 4;

DETAILED DESCRIPTION OF THE PREFERRED EMBODIMENT

Figures 1, 2:
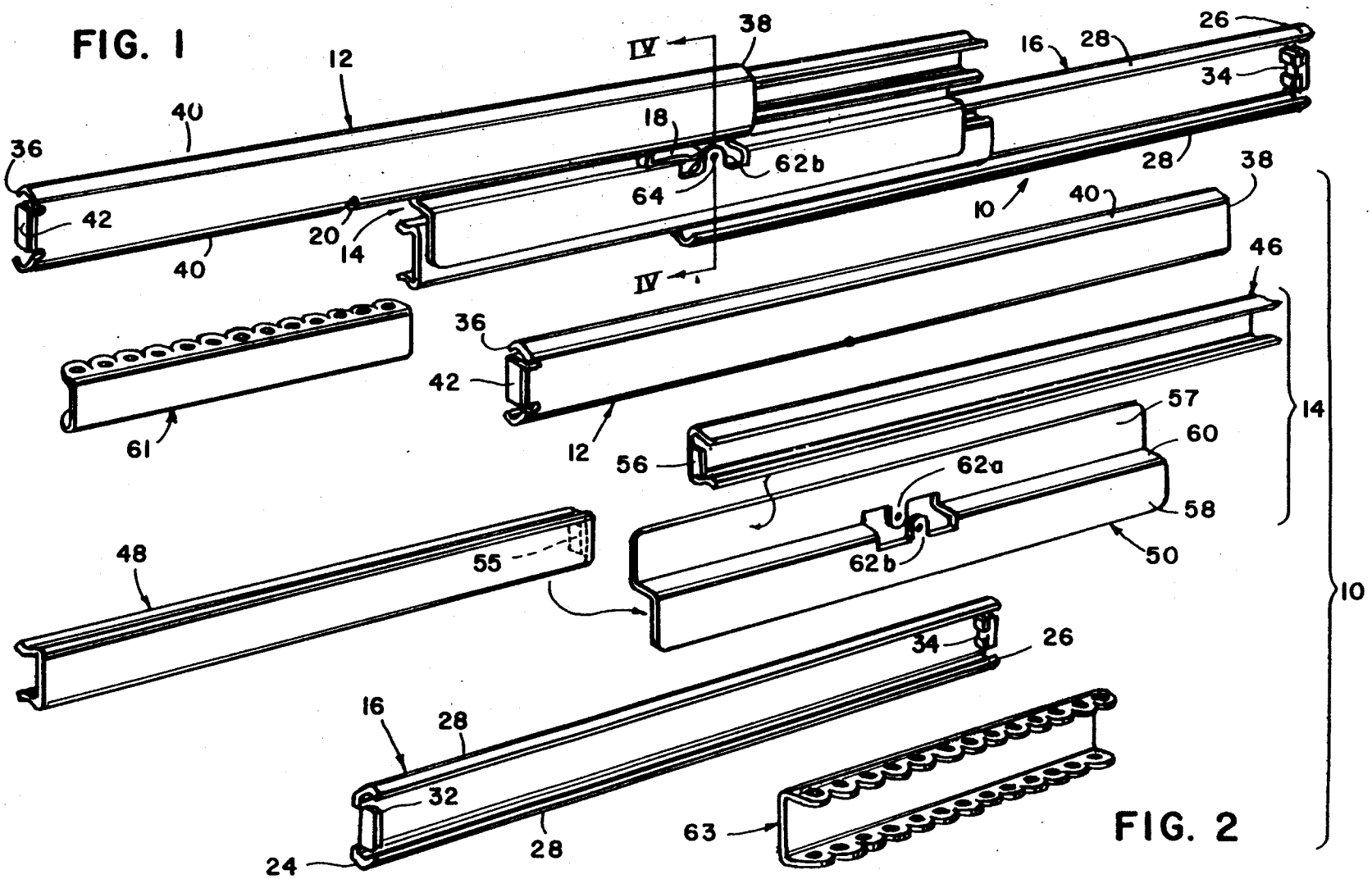
FIG. 1 is a perspective view of the sequential slide of the present invention in the fully open position.
FIG. 2 is a perspective exploded view of the slide.

A sequential drawer slide constructed in accordance with a preferred embodiment of the invention is illustrated in the drawings and generally designated 10. The slide includes a drawer slide member 12, an intermediate slide member 14, and a cabinet slide member 16. Both the drawer and cabinet slide members 12 and 16 are slidably interfitted with the intermediate slide member 14 enabling the slide members to travel in a linear path with respect to one another. The slide 10 further includes a sequencing mechanism including a control lever 18, a drawer notch or receiver 20, and a cabinet receiver 22. The control lever is carried by the intermediate slide member 14; while the drawer and cabinet receivers 20 and 22 are carried by the drawer and cabinet slide members 12 and 16, respectively. As illustrated in detail in FIGS. 7–12, the control lever and receivers cooperate to sequence movement of the slide members to insure that, during opening, the drawer and intermediate slide members are first withdrawn as a unit from the cabinet slide member, and then are interlocked during continued movement of the drawer slide member.

With the exception of the sequencing mechanism, the slide 10 is of a type generally well known to those having ordinary skill in the art. Examples of similar constructions are illustrated in U.S. Pat. Nos. 4,067,632 to Sekerich, entitled DRAWER SLIDE; 3,901,565 to Hagen et al, entitled ADAPTER AND LATCHING MEANS FOR REMOVABLY ATTACHING DRAWERS TO TELESCOPING BALl BEARING DRAWER SLIDES; and 3,778,120 to Hagen et al entitled PRECISION TELESCOPING BALL BEARING DRAWER SLIDE SUSPENSION FOR WOOD AND METAL FURNITURE PRODUCTION.

The cabinet slide member 16 is generally C-shaped in cross section and includes a forward end 24 and a rear end 26. The curved portions 28 of the C-shape define races in which balls 30 ride. Stops or tabs 32 and 34 are integrally formed with the cabinet slide member and extend from the forward and rear ends 24 and 26, respectively. The stops cooperate with the intermediate slide member as will be described to limit the movement of the intermediate slide member 14 with respect to the cabinet slide member 16 between fully extended and fully retracted positions.

The drawer slide member 12 is generally identical to the cabinet channel member 16 with the exception that the drawer member is oriented directly opposite to the cabinet member. The drawer slide member 12 is generally C-shaped in cross section and includes a forward end 36 and a rear end 38. The curved portions 40 of the C-shape define races in which balls 30 ride to slidingly interfit the drawer and intermediate slide members. Integral stops or tabs 42 and 44 extend from the forward and rear ends 36 and 38, respectively. The stops 42 and 44 cooperate with the intermediate slide member 14 as will be described to limit movement of the drawer slide member with respect to the intermediate slide member between fully extended and fully retracted positions.

The intermediate slide member 14 includes three pieces welded, riveted, or otherwise fixedly secured together. The three pieces include a drawer rail 46, a cabinet rail 48, and an interconnecting bracket 50. The drawer and cabinet rails 46 and 48 are generally identical to one another and each are generally C-shaped in cross section. The cabinet rail 48 includes reverse curves 52 at the upper and lower extent of the C-shape cross section to define races in which balls 30 ride. Similarly, the drawer rail 46 includes reverse curves 54 at its upper and lower extent to define races in which balls 30 ride. An integral stop 55 extends from the rear end of the cabinet rail 48; while an integral tab or stop 56 extends from the forward end of the drawer rail 46.

The intermediate bracket 50 is generally Z-shaped in cross section and includes a drawer-rail-supporting flange 57, a cabinet-rail-supporting flange 58, and an interconnecting flange 60. The flanges 57 and 58 are generally parallel to one another and offset by the width of the flange 60. The drawer and cabinet rails 46 and 48 overlie and are welded to the supporting flanges 57 and 58, respectively. Other suitable attachment means can be utilized to rigidly intersecure these pieces.

A plurality of balls (FIGS. 1 and 4) ride in the raceways defined by the drawer and cabinet slide members 12 and 16 and the drawer and cabinet rails 46 and 48. The balls 30 are retained in position by upper and lower retainers 61 and 63 as is customary in the art.

Linear movement of the slide members 12, 14, and 16 is limited via the engagement of the stops 32, 34, 42, and 44 with the drawer and cabinet rail stops 55 and 56 and the ball retainers 61 and 63 as is conventional in the art. In the fully closed or retracted position (FIGS. 3 and 7), the stop 55 on the cabinet rail 48 engages the stop 34 on the cabinet slide member 16, and the stop 56 on the drawer rail 46 engages the stop 42 on the drawer slide member 12. In the open or fully extended position (FIG. 11), the lower ball retainer 63 within the cabinet slide member engages the stop 32 on the cabinet slide member 16 and the stop 55 on the cabinet rail 48; and the upper ball retainer 61 within the drawer slide member 12 engages the stop 44 on the drawer slide member 12 and the stop 56 on the drawer rail 46. Consequently, the intermediate slide member 14 is movable with respect to the cabinet slide member 16 between fully extended and fully retracted positions; and the drawer slide member 12 is movable relative the intermediate slide member 14 between fully extended and fully retracted positions.

Figure 6:
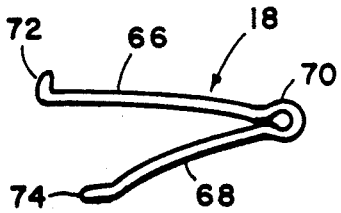
FIG. 6 is a plan view of the control lever.
Figure 8:
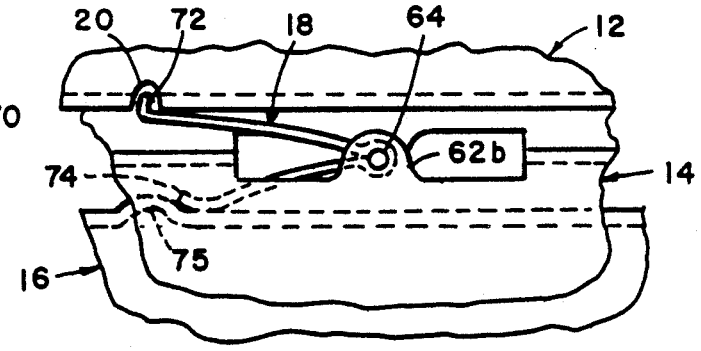
FIG. 8 is a fragmentary enlarged plan view of the control lever area in FIG. 7.

The control lever 18 is illustrated in greatest detail in FIG. 6. The control lever includes an upper arm 66 and a lower arm 68 interconnected at loop 70. The control lever 18 is mounted on a pin 64 which extends through the loop 70 and is supported on arms **62*a* and 62*b*. Accordingly, the control lever can be mounted in the position of the roller in a progressive drawer slide to simplify construction of the slide. Preferably, the entire control lever 18 is formed of an integral piece of material such as steel or plastic. A finger 72 extends upwardly from the terminal end of the arm 66 to selectively engage the notch 20 as will be described. Similarly, a curved foot 74 extends downwardly from the terminal end of the arm 68 to selectively engage the receiver 22 or forward end 24 of the cabinet slide member 16** also as will be described. As seen in FIGS. 4 and 5, the preferred control lever 18 is generally uniform in width. Preferably, the arms 66 and 68 of the control lever are not compressed between the drawer and cabinet slide members 12 and 16 to eliminate drag which would be caused by such compression. Alternatively, and if a stay-closed bump 75 (FIG. 8) is provided, the arms 66 and 68 can be slightly compressed in the closed position in the slide as illustrated in FIG. 8 to permit the foot 74 to ride over the bump. To this end, it is preferable to fabricate the control lever 18 of a resilient material such as spring steel or resilient plastic.

The notch 20 is integrally formed in the drawer slide channel 12 and more particularly in the lower curved position 28 of the C-shape. Alternatively, the receiver could be provided by generally any suitable method providing an engagement mechanism for the control lever 18. The receiver 22 for the cabinet slide member 16 comprises the forward edge 24 of the member. If the control lever 18 were carried at a different position along the length of the intermediate slide member 14 the catch 22 might alternatively be a notch in the cabinet slide member similar to notch 20 in the drawer slide member. Again, any suitable receiver or engagement mechanism can be provided to cooperate with the control lever 18. The position of the receivers 20 and 22 with respect to the control lever 18 is extremely important to the proper sequential operation of the slide members as described below. As illustrated, the drawer notch 20 is approximately midway along the length of the drawer slide 12, and the cabinet detent is immediately adjacent and identical to the forward end 24 of the cabinet slide member 16. In the depicted embodiment, both legs 66 and 68 extend outwardly of the loop 70.

OPERATION

FIGS. 7–12 illustrate the sequential operation of the multi-part slide as sequenced by the control lever 18 and the receivers 20 and 22. As used herein, the terms "forward" or "outward" mean movement toward the position illustrated in FIG. 1 wherein the drawer is fully open; and the terms "rearward" or "irward" mean movement toward the position illustrated in FIG. 7 wherein the drawer is fully closed.

Figure 7:
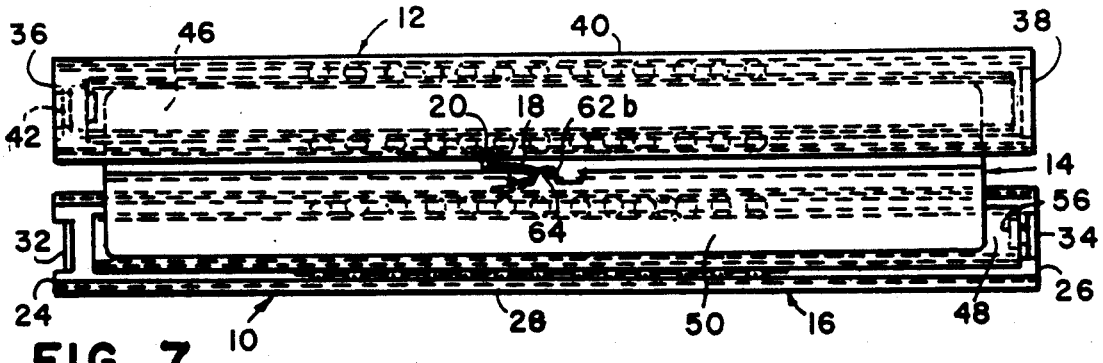
FIG. 7 is a plan view of the slide in the fully closed position.

FIGS. 7 and 8 illustrate the slide 10 in the fully closed position. The cabinet rail 48 abuts the stop 34; and the drawer rail 46 abuts the stop 42. As illustrated in greater detail in FIG. 8, the finger 72 of the control lever 18 interfits with the drawer notch 20, so that the drawer slide member 12 is locked or fixed with respect to the intermediate slide member 14. Movement of the drawer slide member 12 is also prohibited in the rearward direction by the stop 42 engaging the drawer rail 46. If a stay-closed bump 75 is provided, the control lever foot 74 abuts the bump to maintain the drawer in the closed position until an opening force is exerted on the drawer to move the foot over the bump.

Figure 9:
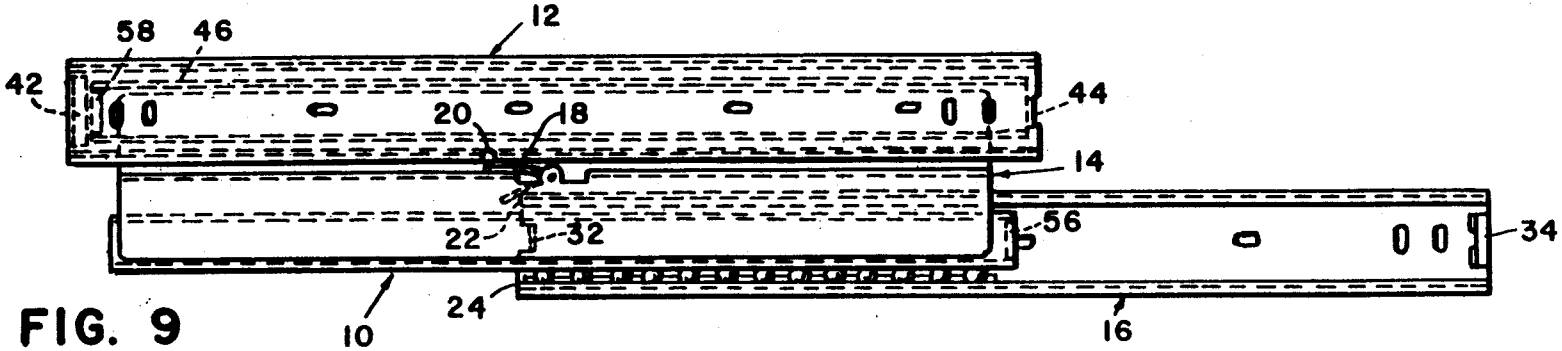
FIG. 9 is a plan view of the slide in the half-open or the "transition point" position.
Figure 10:
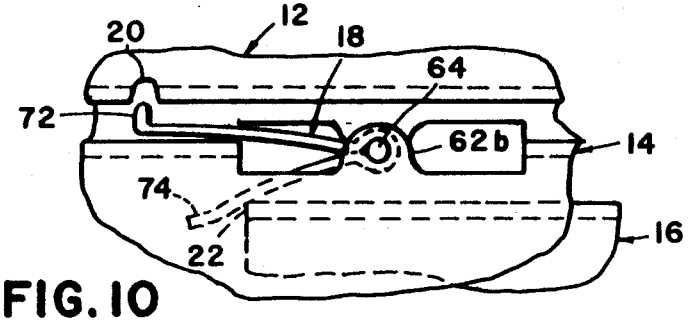
FIG. 10 is fragmentary enlarged plan view of the control lever area in FIG. 9.

Initial withdrawal of a drawer supported on the slide 10 causes the interlocked drawer and intermediate slide members 12 and 14 to move as a unit with respect to the cabinet slide member 16 until the position illustrated in FIGS. 9 and 10 is reached. The position illustrated in FIGS. 9 and 10 is known both as the "half-open" position and as the "transition point". This stage of extension (i.e. drawer opening) is referred to as the transition point because it is the location at which movement of the intermediate slide member 14 stops and at which movement of the drawer slide member 12 begins.

At the transition point, the channel ball retainer 63 (not visible), engages the forward stop 32 on the cabinet slide member 16 and the stop 55 on the cabinet rail 48 to prevent further movement of the intermediate slide in the forward direction. At this point, the foot 74 of the control lever 18 drops under gravity down in front of the receiver 22 or forward end 24 of the cabinet slide member 16 (FIG. 10). This slight pivotal shifting movement of the control lever 18 disengages the finger 72 from the notch 20. After the control lever 18 has shifted at the transition point during opening, the intermediate and cabinet slide members 14 and 16 are interlocked (i.e. intersecured). Engagement of the control lever foot 74 with the forward edge 22 of the channel slide member prevents rearward movement of the intermediate slide member 14 with respect to the cabinet slide member. As noted above, engagement of the cabinet ball retainer 63 with the forward stop 32 prevents forward movement of the intermediate slide member with respect to the cabinet slide member.

As the drawer continues to be withdrawn or extended from the cabinet, the drawer slide member 12 moves relative the intermediate slide member 14 toward its fully extended position. The finger 72 does not engage the drawer slide member 12 during this continued opening movement as illustrated in FIG. 12.

Figure 12:
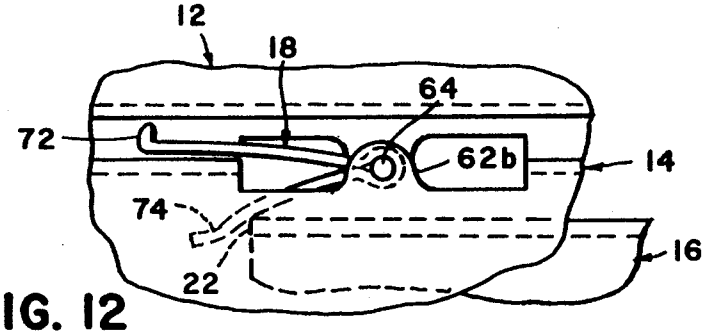
FIG. 12 is a fragmentary enlarged plan view of the control lever area in FIG. 11.
Figure 11:
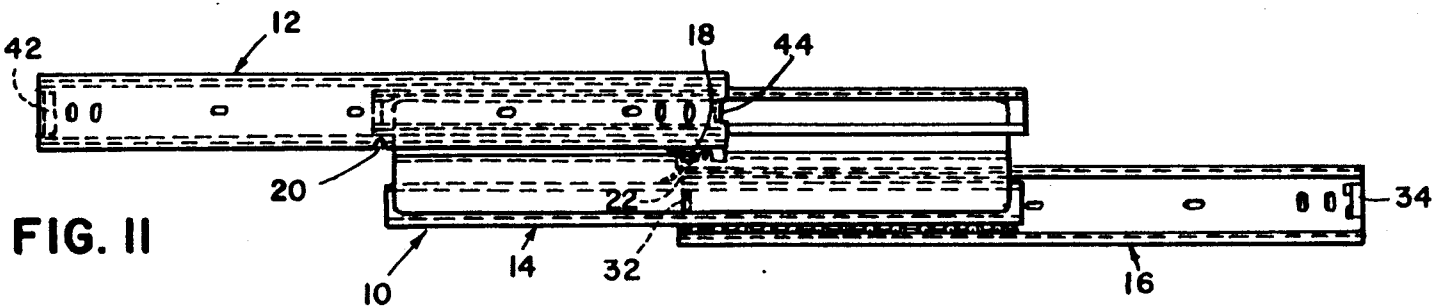
FIG. 11 is a fragmentary plan view of the slide in the fully opened position.

The fully open position of the slide 10 is illustrated in FIGS. 11 and 12. The control lever foot 74 still engages the cabinet member end 22; and the cabinet ball retainer 63 still engages the stops 32 and 55 to interlock the intermediate and cabinet members 14 and 16. Additionally, the drawer ball retainer 61 (not illustrated in FIG. 11) engages the stops 44 and 56 to limit further forward movement of the drawer slide member 12 with respect to the intermediate slide member 14.

The closing sequence of the slide is exactly opposite that described for the opening sequence with the slide passing from the fully extended position illustrated in FIGS. 11 and 12 to the half-open position illustrated in FIGS. 9 and 10 to the fully retracted position illustrated in FIGS. 7 and 8. On closing, the inward push on the drawer slide member 12 tends to rotate the control lever 18 by lifting, but the finger 72 strikes the bottom edge of the drawer slide member to prevent the control lever from pivoting. Consequently, the cabinet and intermediate slide members remain interlocked. As the slide 10 reaches the half-open position (FIGS. 9 and 10), the finger 72 meets and is lifted up into the notch 20 because the foot 74 is lifted back on top of the cabinet slide member 16. In the preferred embodiment, there is no drag or catch at the transition point as the control lever shifts. Only an unnoticeable force is required to lift the control lever 18 as one slide member is released and another is locked. In the alternative construction, the control lever is slightly compressed when the drawer and intermediate rails are interlocked. If compression is light, any increased frictional drag caused thereby is minimal or even unnoticeable.

The simple sequencing mechanism, comprising the control lever 18 and the detents 20 and 22, insures that (1) during opening, the intermediate slide member 14 is fully extended before the drawer slide member 12 begins its movement and (2) during closing, the drawer slide member 12 is fully retracted before the intermediate slide member 14 begins its movement. This sequenced motion of the drawer slide greatly enhances the slide life and/or enables lighter weight components to be utilized in its manufacture. The sequencing mechanism requires an unnoticeable change in opening or closing force to move the drawer past the transition point during closing.

Tests conducted to date indicate that the present slide has a functional life approximately 4 to 8 times longer than that of commercially available progressive slides with rollers. The increased life is due to (1) decreased dynamic stress loading on the outer end of the cabinet slide member and (2) the long life of the control lever sequencing mechanism, which is not subjected to the continual wear of a progressive roller.

ALTERNATIVE EMBODIMENT

Figure 13:
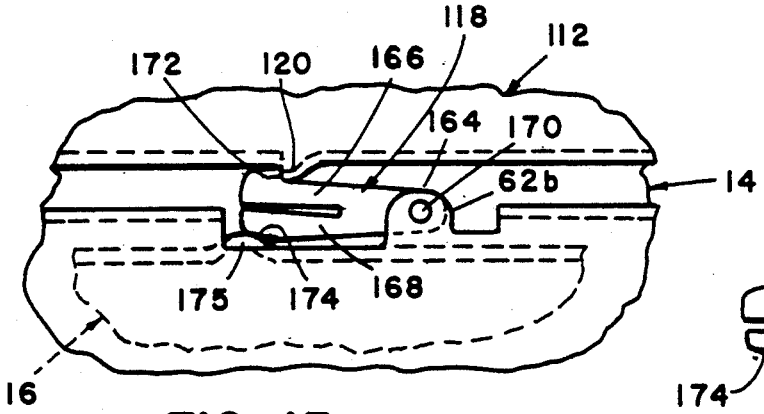
FIG. 13 is a view similar to FIG. 8 showing an alternative control lever.
Figure 14:
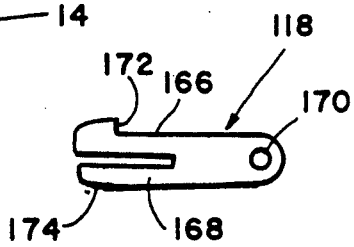
FIG. 14 is a plan view of the alternative control lever.

An alternative control lever 118 (FIGS. 13 and 14) is fabricated of plastic. The alternative lever includes an upper arm 166 and a lower arm 168 interconnected by a body portion 170. The lever 118 is mounted on a pin 64 which extends through the body portion 170 and is supported on arms 62*a* (not visible) and 62*b*. A finger 172 extends upwardly from the upper arm 166 to selectively engage the catch 120 on the drawer slide member 112. The terminal end of the lower arm 168 is beveled at 174 to facilitate passage of the lever 118 over the stay-closed bump 175. The function of the alternative lever 118 is generally identical to that of the lever 18 with the exception that the finger 172 selectively engages a catch 120 rather than a notch.

The above description is that of a preferred embodiment of the invention. Various alterations and changes can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A sequential drawer slide comprising:

a cabinet slide member;

an intermediate slide member mounted for linear movement with respect to said cabinet slide member between extended and retracted positions;

a drawer slide member mounted for linear movement with respect to said intermediate slide member between extended and retracted positions; and sequencing means for sequencing the operation of said slide members so that only one of said cabinet and drawer slide members is permitted to move with respect to said intermediate slide member at any given position of said slide members, said sequencing means including a control lever member shiftably supported by said intermediate slide member between first and second positions, said sequencing means further including first and second engagement means on said drawer and cabinet slide members, respectively, said control lever member coacting with said first engagement means when in the first position and with said second engagement means when in the second position to aid in interlocking said intermediate slide member with the one of said cabinet and drawer slide members carrying the coacting engagement means, said control lever member being shiftable between the first and second positions when said intermediate rail is in its extended position and said drawer rail is in its retracted position.

2. A sequential drawer slide as defined in claim 1 wherein said control lever member is approximately midway along the length of said intermediate slide member.

3. A sequential drawer slide as defined in claim 2 wherein said second engagement means comprises the forward end of said cabinet slide member, said control lever member engaging said forward end when in the second position.

4. A sequential drawer slide as defined in claim 3 wherein said first engagement means comprises a notch formed in said drawer slide member and positioned to receive said control lever member when in the first position.

5. A sequential drawer slide as defined in claim 4 wherein said control lever member is gravity actuated in moving from the first position to the second position.

6. A sequential drawer slide as defined in claim 5 wherein said control lever member is pivotally supported by said intermediate slide member and includes first and second arms extending forwardly of the pivotal support and selectively engaging said first and second engagement means, respectively.

7. An improved sequential drawer slide comprising:

cabinet, intermediate, and drawer slide members;

antifriction means for slidingly interfitting each of said cabinet and drawer slide members with said intermediate slide member for relative linear movement;

stop means for limiting the extent to which both of said cabinet and drawer slide members can be moved with respect to said intermediate slide member;

sequencing means for permitting relative movement between only one of said cabinet and drawer slide members and said intermediate slide member at substantially all times;

wherein the improvement comprises said sequencing means comprising a control element supported by said intermediate slide member and shiftable between first and second positions, said control element when in the first position engaging said drawer slide member and cooperating with said stop means to prevent relative movement between said drawer and intermediate slide members, said control element when in said second position engaging said cabinet slide member and cooperating with said stop means to prevent relative movement between said cabinet and intermediate slide members.

8. A sequential drawer slide as defined in claim 7 wherein said sequencing means insures that, during extension of said slide, said intermediate slide member is fully extended prior to any extension of said drawer slide member.

9. A sequential drawer slide as defined in claim 7 wherein said drawer slide member is directly above said cabinet slide member, and further wherein said control element is positioned between said drawer and cabinet slide members.

10. A sequential drawer slide as defined in claim 7 wherein said control element is approximately midway along the length of said intermediate slide member.

11. A sequential drawer slide as defined in claim 7 wherein said control element is gravity actuated in moving from the first position to the second position and lifted in moving from the second to the first position.

12. A sequential drawer slide comprising:

a cabinet slide member;

an intermediate slide member slidingly interfitted with said cabinet slide member and movable with respect thereto between extended and retracted positions;

a drawer slide member slidingly interfitted with said intermediate slide member and movable with respect thereto between extended and locked positions: and sequencing means for sequencing the movement of said slide members, said sequencing means including a cabinet engagement means and a drawer engagement means on said cabinet and drawer slide members, respectively, and a shifting control lever carried by said intermediate slide member and shiftable between first and second positions when one of said intermediate and drawer slide members is fully retracted and the other of said slide members is fully extended, said shifting control lever engaging said drawer engagement means when in the first position to restrict movement between said one slide member and said intermediate slide member, said shifting control lever engaging said cabinet engagement means when in the second position to restrict movement between said other slide member and said intermediate slide member, whereby said sequencing means permits only one of said channel and drawer slide members to move relative said intermediate slide member at substantially all times.

13. A sequential drawer slide as defined in claim 12 wherein said one and other slide members comprise said intermediate and drawer slide members, respectively, whereby said intermediate slide member is fully extended before said drawer slide member is extended at all.

14. A sequential drawer slide as defined in claim 12 wherein said shifting control lever is approximately midway along the length of said intermediate slide member.

15. A sequential drawer slide as defined in claim 14 wherein one of said drawer and cabinet engagement means is immediately adjacent an end of its respective slide member.

16. A sequential drawer slide as defined in claim 12 wherein at least one of said drawer and cabinet engagement means comprises a notch forced in its respective slide member.

17. A sequential drawer slide as defined in claim 12 wherein said shifting member is gravity actuated in moving from the first position to the second position and lifted in moving from the second position to the first position.

18. A sequential drawer slide as defined in claim 12 wherein said drawer slide member is directly above said cabinet slide member, and further wherein said shifting control lever is located between said drawer and cabinet slide members.

19. A sequential drawer slide as defined in claim 18 wherein said shifting control lever is pivotally secured to said intermediate slide member and includes first and second arms for engaging said cabinet and drawer slide members, respectively.

20. A sequential drawer slide assembly comprising:

a cabinet slide;

an intermediate slide interfitted with said cabinet slide and movable between extended and retracted positions;

a drawer slide interfitted with said intermediate slide and movable between extended and retracted positions; and sequencing control means for controlling the movement of said intermediate and drawer slides, said control means including a gravity operable control latch on said intermediate slide and engageable with said cabinet and drawer slides, said control latch latching said drawer and intermediate slides together in retracted condition relative to each other when said intermediate slide is in other than a fully extended condition relative to said cabinet slide, said control latch being releasable by said cabinet slide at full extension of said intermediate slide relative to said cabinet slide to allow extension of said drawer slide relative to said intermediate slide.

21. A sequential drawer slide assembly as defined in claim 20 wherein said control latch latches said intermediate slide and said cabinet slide together in extended condition relative to each other during movement of said drawer slide, said control latch being releasable by said drawer slide at full retraction of said drawer slide relative to said intermediate slide simultaneously with latching of said drawer slide to said intermediate slide to cause retraction of said drawer and intermediate slides together.

22. A sequential drawer slide assembly as defined in claim 21 wherein said control latch is a lever pivotally mounted to said intermediate slide, is gravity biased to a downward pivoted position for latching with said cabinet slide, and is liftable by said cabinet slide for latching with said drawer slide.

23. A sequential drawer slide assembly as defined in claim 22 wherein said control latch has an upper finger to latch with said drawer slide, said drawer slide including a notch for receiving said upper finger, and further wherein said control latch has a lower finger engaging the upper edge of said cabinet slide when said drawer slide and intermediate slide are latched.

24. A sequential drawer slide comprising:

a cabinet slide member;

an intermediate slide member slidingly interfitted with said cabinet slide member and movable with respect thereto between extended and retracted positions;

a drawer slide member slidingly interfitted with said intermediate slide member and movable with respect thereto between extended and locked positions; and sequencing means for sequencing the movement of said slide members, said sequencing means including a single control element carried by said intermediate slide member and sequentially engageable with said cabinet and drawer slide members, said control element engaging said drawer slide member and maintaining said drawer slide member in its retracted position with respect to said intermediate slide when said intermediate slide member is in other than its extended position, said control element engaging said cabinet slide member and maintaining said intermediate slide member in its extended position with respect to said cabinet slide member during movement of said drawer slide member with respect to said intermediate slide member.

25. An improved sequential drawer slide comprising: cabinet, intermediate, and drawer slide members;

antifriction means for slidingly interfitting each of said cabinet and drawer slide members with said intermediate slide member for relative linear movement;

stop means for limiting movement of said intermediate slide member with respect to said cabinet slide member between retracted and extended positions and for limiting movement of said drawer slide member with respect to said intermediate slide member between retracted and extended positions;

sequencing means for permitting relative movement between only one of said cabinet and drawer slide members and said intermediate slide member at substantially all times;

wherein the improvement comprises said sequencing means comprising:

a control element carried directly by said intermediate slide member; and cabinet and drawer engagement means mounted directly on said cabinet and drawer slide members, respectively, sequentially engageable by said control element, said control element engaging said drawer engagement means to hold said drawer slide member in its retracted position during relative movement of said intermediate and cabinet slide members, said control element engaging said cabinet engagement means to hold said intermediate slide member in its extended position during relative movement of said drawer and intermediate slide members.

26. An improved three member drawer slide of the type having a drawer slide affixed to an intermediate member and a cabinet slide positioned below said drawer slide and affixed to said intermediate member, said drawer slide having a drawer slide outer member, a drawer slide inner member and said drawer slide having a plurality of ball bearings held by an upper ball retainer and said cabinet slide having a cabinet slide outer member, a cabinet slide inner member and a plurality of ball bearings held by a lower ball retainer wherein the improvement comprises means to cause the movement of the lower ball retainer to occur before the movement of the upper ball retainer, said means comprising:

releasable gripping means affixed to said intermediate member and contacting and holding the drawer slide outer member when said drawer slide outer member is fully retracted and releasing its grip on the drawer slide outer member when said cabinet slide outer member is fully extended, whereby when said three member drawer slide is extended from a fully retracted position, the cabinet slide outer member will move outwardly completely before the drawer slide outer member will move with respect to the drawer slide inner member;

said releasable gripping means comprising a pivotable arm held by said intermediate member between the outer members of the drawer and cabinet slides, said pivotable arm resting on the upper surface of the cabinet slide outer member and having an upwardly extending finger contacting a receiver on the underside of the drawer slide outer member and said pivotable arm being positioned to fall downwardly slightly when said cabinet slide outer member is fully extended, thereby causing said upwardly extending finger to release its contact against the catch allowing the drawer slide outer member to extend from its inner member.

27. The improved three member drawer slide of claim 2 wherein said pivotable arm is formed from a length of flexible material bent over a pivot pin held by said intermediate member.

28. The improved three member drawer slide of claim 2 wherein said flexible material is spring steel.

* * * * *

UNITED STATES PATENT AND TRADEMARK OFFICE

CERTIFICATE OF CORRECTION

PATENT NO. : 4,988,214

DATED : Jan. 29, 1991

INVENTOR(S) : Gene R. Clement

It is certified that error appears in the above-identified patent and that said Letters Patent is hereby corrected as shown below:

Column 3, line 43:

"BAL1" should be -- BALL -- ;

Column 5, line 41:

""irward"" should be --inward-- ;

Column 9, line 46:

"forced" should be --formed--.

Signed and Sealed this

Twenty-fifth Day of August, 1992

*Attest:*

DOUGLAS B. COMER

*Attesting Officer*

*Acting Commissioner of Patents and Trademarks*